US007695302B2

(12) United States Patent
Eissner et al.

(10) Patent No.: US 7,695,302 B2
(45) Date of Patent: Apr. 13, 2010

(54) ELECTRICAL CONNECTOR

(75) Inventors: Roland Eissner, Bruchsal-Untergrombach (DE); Norbert Roller, Ilsfeld (DE)

(73) Assignee: Woodhead Industries, Inc., Deerfield, IL (US)

( * ) Notice: Subject to any disclaimer, the term of this patent is extended or adjusted under 35 U.S.C. 154(b) by 481 days.

(21) Appl. No.: 10/557,057

(22) PCT Filed: Apr. 14, 2004

(86) PCT No.: PCT/DE2004/000793

§ 371 (c)(1),
(2), (4) Date: Apr. 10, 2008

(87) PCT Pub. No.: WO2004/109865

PCT Pub. Date: Dec. 16, 2004

(65) Prior Publication Data

US 2008/0207040 A1 Aug. 28, 2008

(30) Foreign Application Priority Data

Mar. 31, 2003 (DE) ..... 103 24 794

(51) Int. Cl.
*H01R 13/627* (2006.01)

(52) U.S. Cl. ..... 439/352; 439/349

(58) Field of Classification Search ..... 439/349, 439/350, 352

See application file for complete search history.

(56) References Cited

U.S. PATENT DOCUMENTS

| | | | | |
|---|---|---|---|---|
| 4,423,919 | A * | 1/1984 | Hillis | 439/609 |
| 5,195,904 | A * | 3/1993 | Cyvoct | 439/349 |
| 5,637,010 | A * | 6/1997 | Jost et al. | 439/352 |
| 5,695,224 | A * | 12/1997 | Grenier | 285/104 |
| 6,142,812 | A * | 11/2000 | Hwang | 439/352 |
| 6,645,011 | B2 * | 11/2003 | Schneider et al. | 439/609 |
| 6,709,289 | B2 * | 3/2004 | Huber et al. | 439/578 |

* cited by examiner

*Primary Examiner*—Thanh-Tam T Le
(74) *Attorney, Agent, or Firm*—Wildman, Harrold, Allen & Dixon LLP

(57) ABSTRACT

An electrical plug connector including two mating connectors. A first plug section includes a receiving sleeve which encircles the first coupling section and which carries a locking element which includes flexible tabs movable between a locking position and an unlocking position and which are pre-stressed in its locking position. Held displaceably on the receiving sleeve is a sliding or release sleeve which may be manually moved axially to engage the locking element and release the mating connector. The second plug section has a plug tube which surrounds the second coupling section. When the plug tube is inserted in the receiving sleeve, the locking element rests on the outside of the plug tube in its locking position whereby the plug sections are connected. The connectors can be released by actuating the sliding sleeve to move the locking element into its unlocking position.

21 Claims, 8 Drawing Sheets

ELECTRICAL CONNECTOR

RELATED APPLICATION

Figure 1:
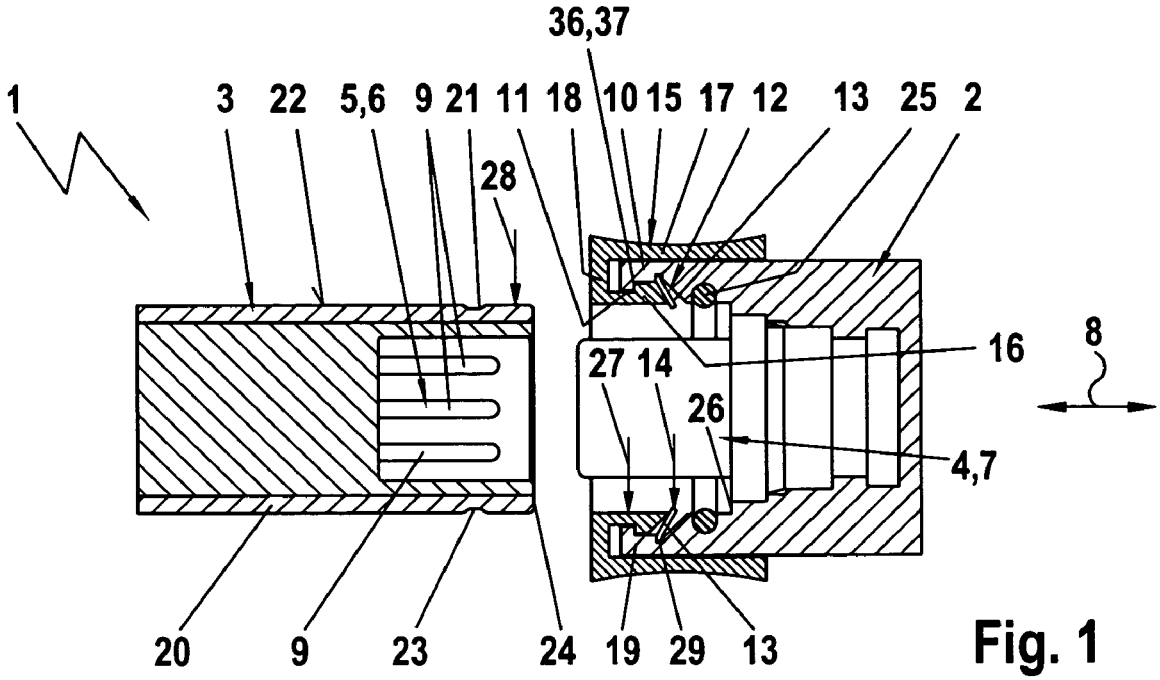

This application claims benefit of an application filed under the Patent Cooperation Treaty entitled "Electrical Plug-In Connection", Application No. PCT/DE2004/000793, filed Apr. 14, 2004, Publication No. WO 2004/109865 A1, Publication Date of Dec. 16, 2004, which is entitled to the priority date of German Utility Model entitled "Elektrische Steckverbindung", Application No. 103 24 794.7, filed May 31, 2003.

FIELD OF THE INVENTION

The present invention relates to an electrical connector including mating male and female connectors, sometimes referred to as "quick disconnect" connectors.

BACKGROUND OF THE INVENTION

A plug connector is disclosed, for example, in German Patent DE 197 49 130 C1 and has two complementary, mating plug sections which contain mutually complementary electrical coupling sections. The first plug section comprises a receiving sleeve which encircles the first coupling section and which has on its inside a locking element in the form of a ring with internally projecting spring lugs. The locking element is displaceable between a locking position and an unlocking position and is pre-stressed in its locking position as a result of its spring elasticity. Held displaceably on a receiving sleeve is a sliding sleeve with which the locking element can be transferred to its unlocking position. The second plug section has a plug tube which surrounds the second coupling section. When the plug tube is inserted in the receiving sleeve, the locking element can rest in its locking position on the outside of the plug tube which appropriately has an annular groove at this point whereby the plug sections are secured on one another. This securing can be released by actuating the sliding sleeve to move the locking element into its unlocking position for which purpose an actuating section of the sliding sleeve interacts with the locking element.

In the known plug connection the sliding sleeve is held on the receiving sleeve by the fact that at an end distant from the locking element the sliding sleeve has an inwardly projecting collar which engages in an external circumferential groove which is incorporated externally in the receiving sleeve or in the first plug section. This groove in this case forms two axial stops which limit the axial displaceability of the sliding sleeve. The dimensioning of the groove is selected such that the sliding sleeve is movable within its axial stops to such an extent that the actuating section of the sliding sleeve can come completely free from the locking element. Moreover, in the known plug connection the receiving sleeve is formed integrally on the first plug section, that is the first plug section and receiving sleeve are manufactured from one piece.

The generic plug connection thus operates according to the so-called push-pull principle and is configured as self-securing for the plugging process. Another plug connection of this type is known for example from German Patent DE 299 11 792 U1 which substantially differs from the plug connection described above in that the sliding sleeve is pre-stressed in its rest position.

This is achieved in the known plug connection with the aid of an additional compression spring which is inserted in an annular cavity between the actuating section and an externally located grip section of the sliding sleeve and is supported in the axial direction on the one hand on the sliding sleeve and on the other hand on an axial front face of the first plug section. By means of this measure the handling of the plug connection, especially the first plug section, can be considerably simplified. At the same time, independent relative movements of the sliding sleeve which could result in undesirable development of noise in an environment rich in vibrations and oscillations, are suppressed. However, the known plug connection is comparatively expensive to manufacture since an additional component, namely the additional compression springs, must be incorporated in an additional production step. However, since series-produced parts are involved in the manufacture of the present invention, a significant cost disadvantage is thereby obtained.

SUMMARY OF THE INVENTION

The present invention is concerned with the problem of providing an improved embodiment for a plug connection of the type specified initially which in particular makes it possible to achieve improved handling, reduced vibration in use, and can be manufactured inexpensively.

This problem is solved according to the present invention. Advantageous or preferred embodiments are also disclosed.

The invention is based on the general idea of using the spring force present in any case on or in the locking element for pre-stressing the sliding sleeve (sometimes referred to as the release sleeve) in its rest position. This is achieved by suitable dimensioning which allows the locking element to drive the sliding sleeve into its rest position via the actuating section. By this measure the locking element obtains a dual function, while reducing vibration, so that an additional compression spring for pre-stressing the sliding sleeve is avoided. This is an enormous advantage especially with a series-produced part of this type since the production costs are not increased or only insignificantly increased compared with a conventional plug connection and at the same time, increased actuation comfort, simplified handling and reduced noise development during vibrations can be achieved.

According to an especially advantageous embodiment, at least when the second plug section is at a distance from the first mating plug section, the locking element can press the sliding sleeve towards an axial stop defining the rest position of the sliding sleeve such that it abuts thereon and is secured thereto. With this construction the sliding sleeve automatically occupies its rest position at least when the plug connection is released. An embodiment is preferred in which the two plug sections are matched to one another such that when the plug sections are inserted into one another in the securing or connecting state, that is especially in the locking position of the locking element, the locking element presses the sliding sleeve against the axial stop defining the rest position of the sliding sleeve so that it abuts thereon, and further axial movement of the sliding sleeve is prevented. In this way, even in the plugged-in or connected state, defined relative positions between locking element and plug section are given which especially supports reduced development of noise due to vibrations.

According to another disclosed embodiment, the sliding sleeve can be held on or coupled to the receiving sleeve on the inside of the receiving sleeve. This method of construction thus dispenses with any holding of the sliding sleeve on the outside of the receiving sleeve, which is advantageous with regard to the functional safety of the sliding sleeve since the outside of the plug sections may become contaminated during operation of the plug connection depending on the area of usage. In cases where the sliding sleeve is held externally on the receiving sleeve, such contamination can result in the axial mobility of the sliding sleeve being impaired. However, in order that the sliding sleeve can fulfill its function, namely releasing the locking element, its axial displaceability must not be impaired. An internally located support according to the proposed method of construction has only a reduced risk of contamination.

In an advantageous embodiment the locking element can be constructed as a spring ring which has a plurality of locking lugs distributed in the circumferential direction, which project inwards with a radial component and are displaceable in a spring-elastic fashion in the plug direction between the locking position and the unlocking position, wherein an inner cross-section of the spring ring in the locking position is smaller than that in the unlocking position. With this method of construction the locking element produces a spring force which pre-stresses the locking element in its locking position itself whereby an extremely simple structure is obtained for the plug connection.

Further important features and advantages of the invention are disclosed in the drawings and the relevant description of the drawings.

It is to be understood that the aforesaid features and those to be explained subsequently can be used not only in the respectively given combination but also in other combinations or alone, without going beyond the scope of the present invention.

Preferred exemplary embodiments of the invention are shown in the drawings and are explained in detail in the following description wherein the same reference numbers refer to the same or functionally the same or similar components.

Figure 2:
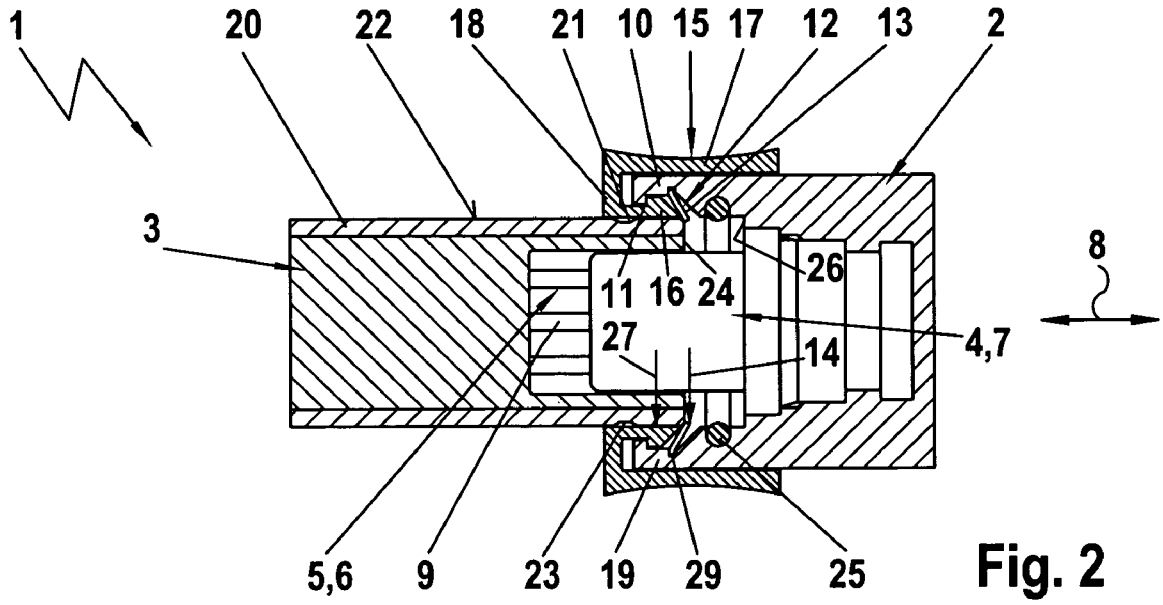
Figure 3:
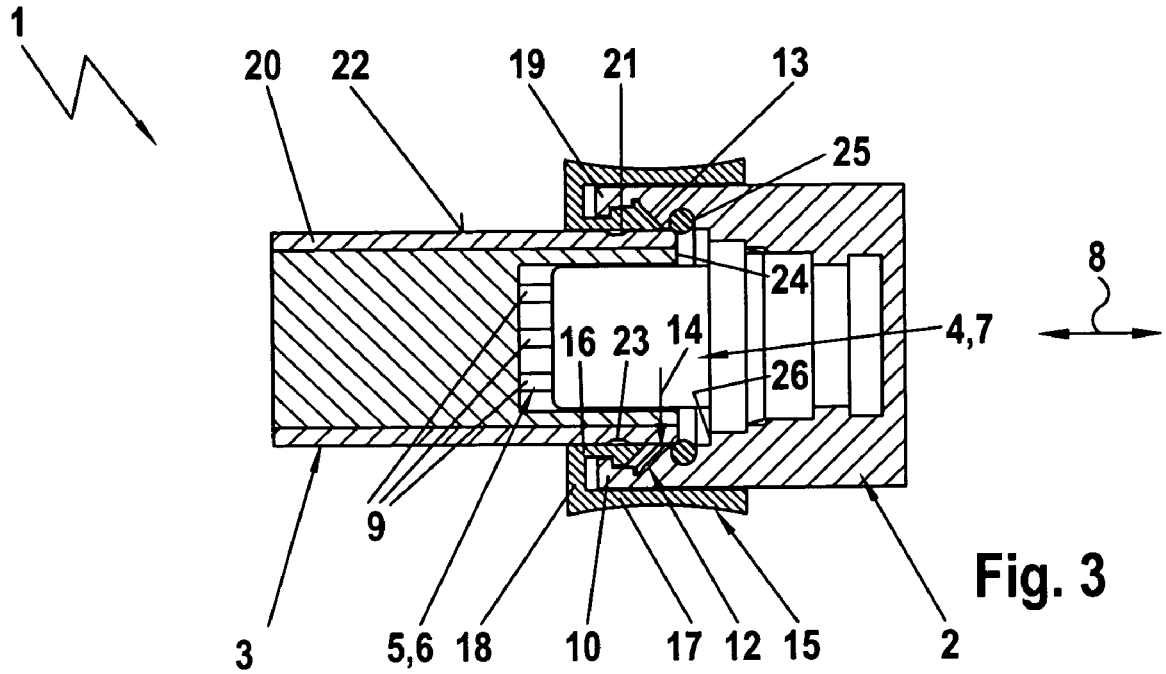
Figure 4:
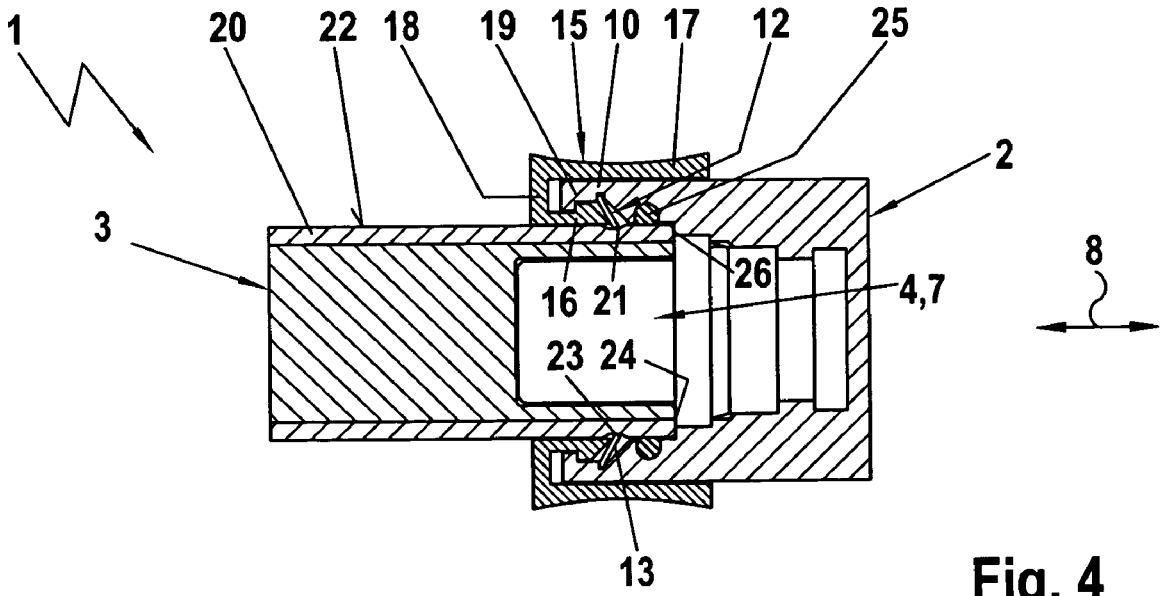
Figure 5:
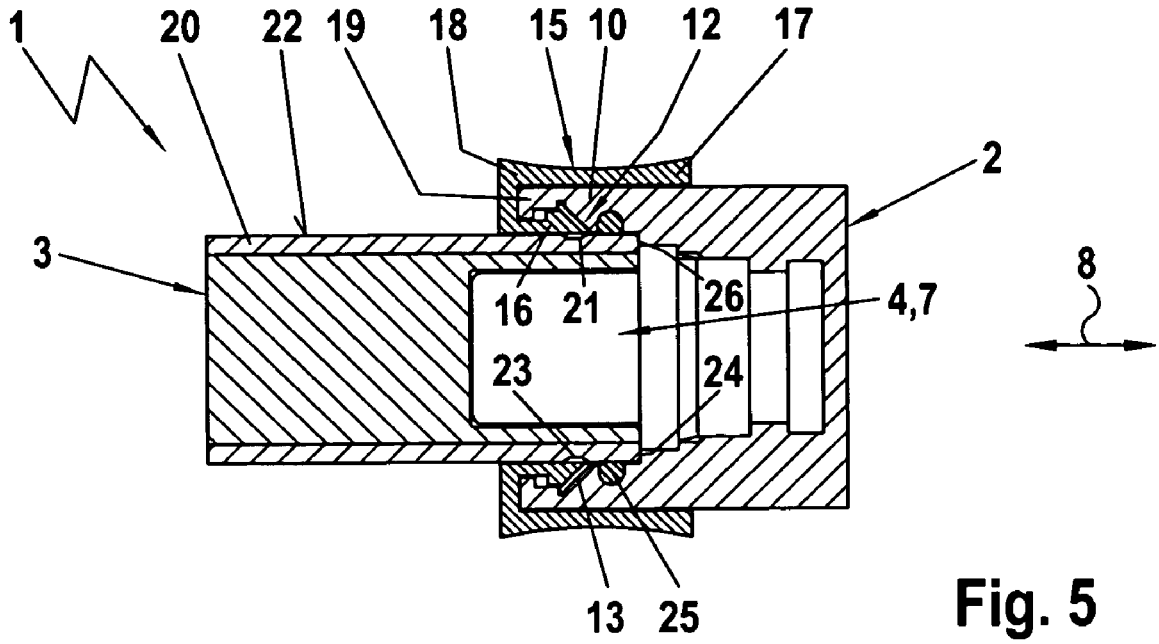
Figure 6:
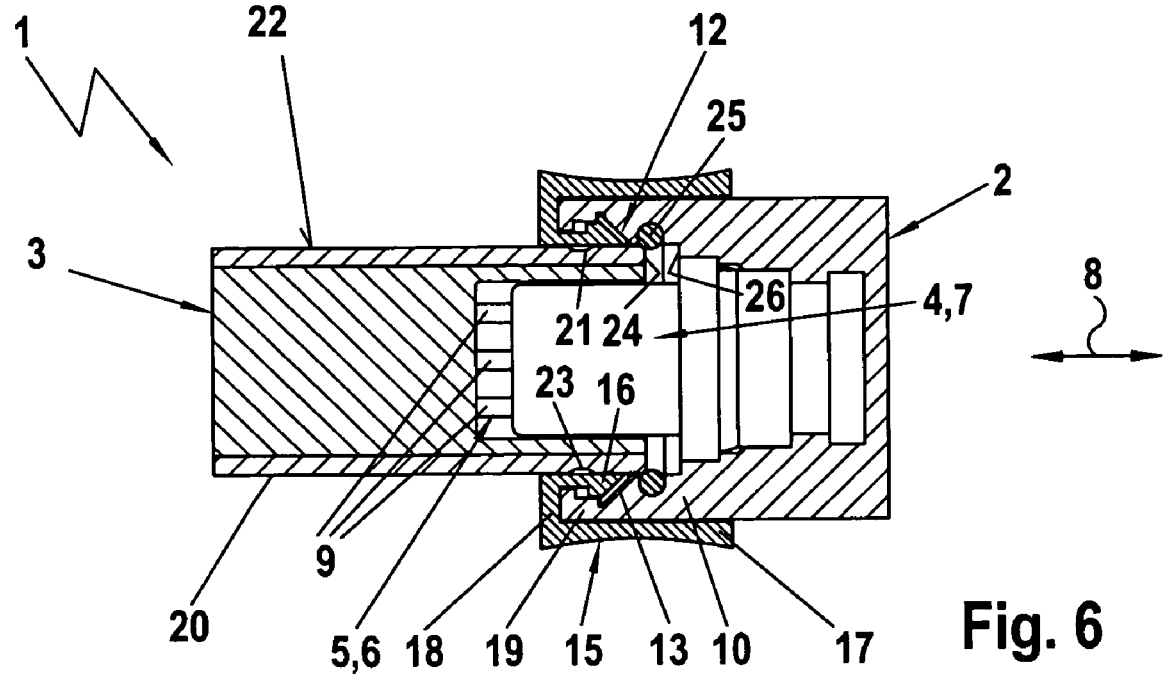
Figure 7:
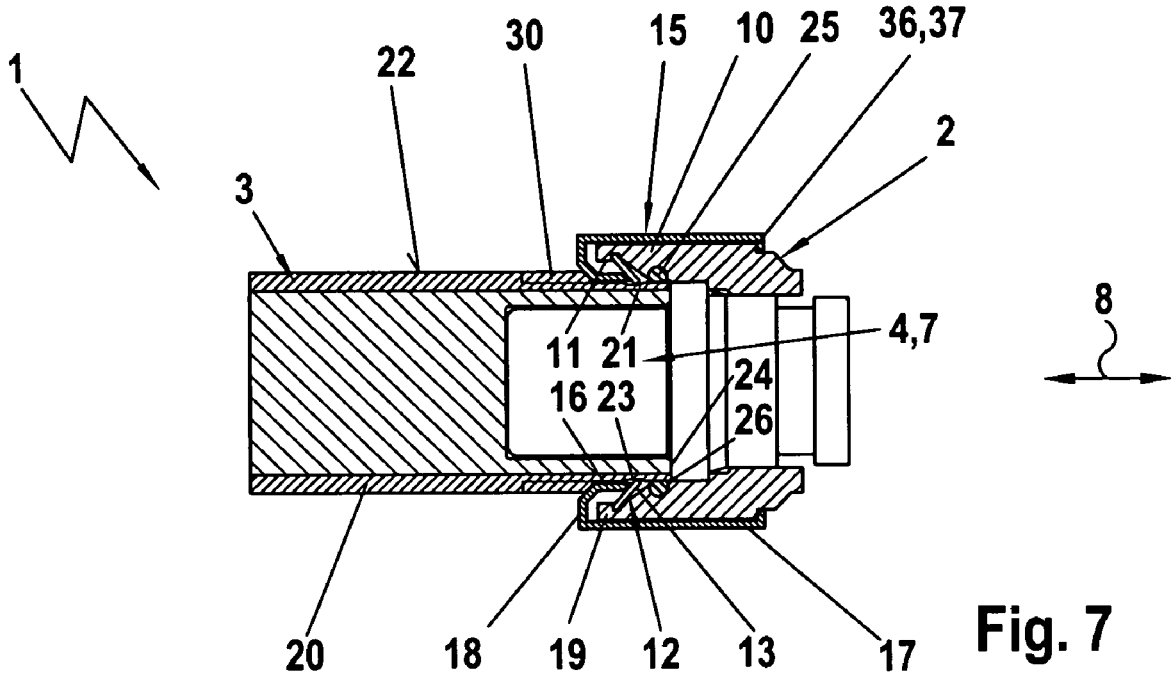
Figure 8:
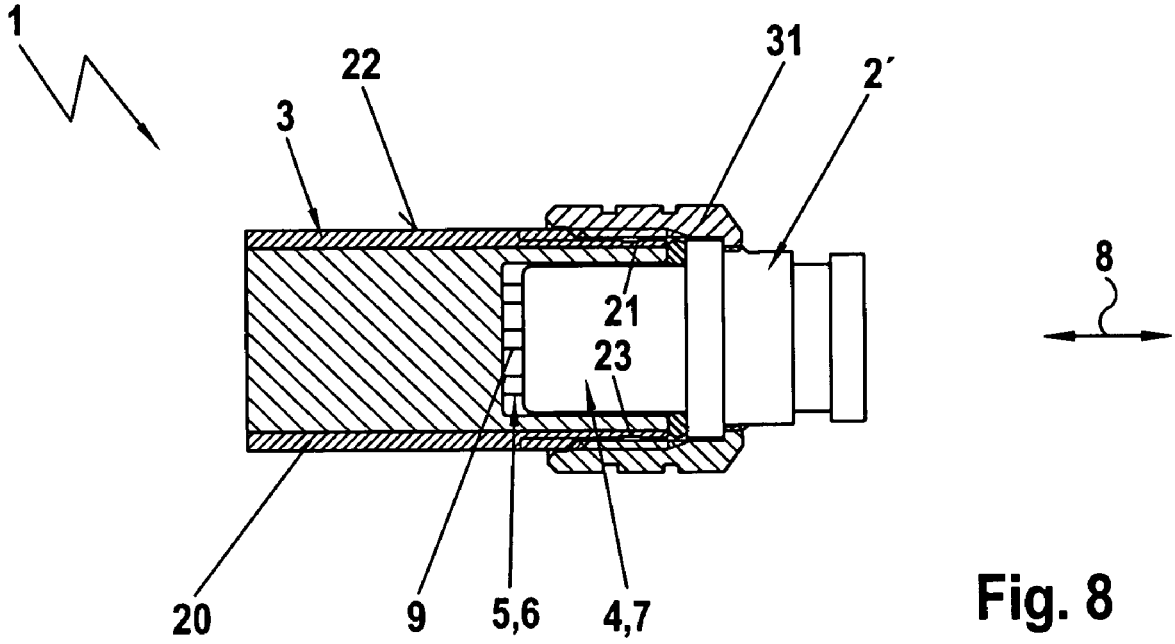
Figure 9:
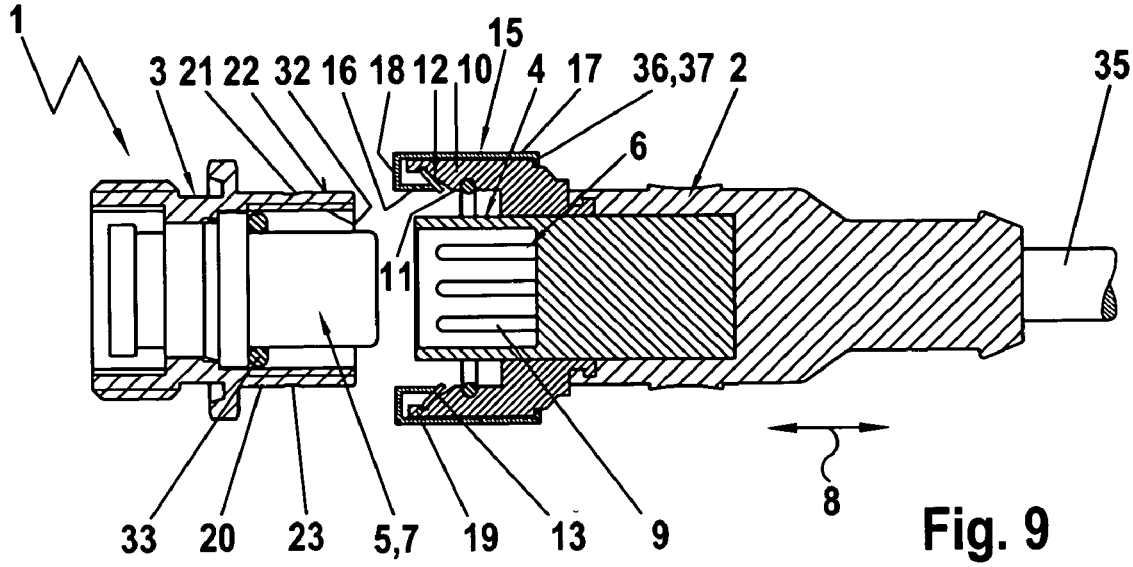
Figure 10:
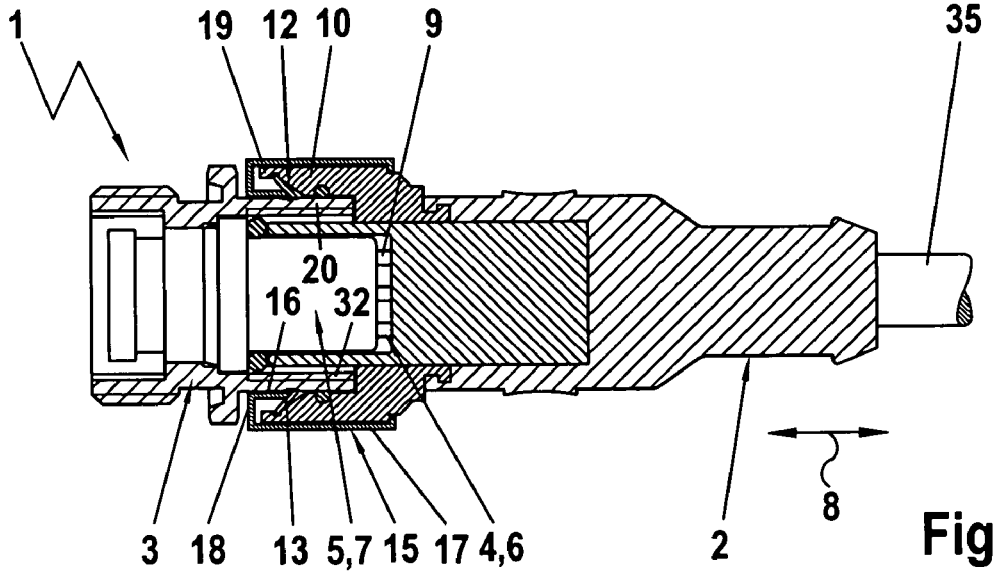
Figure 11:
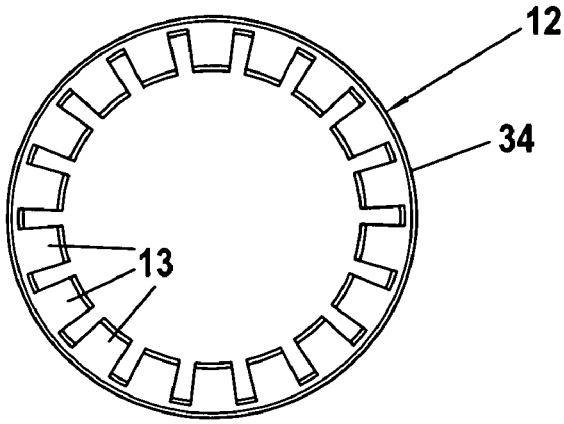
Figure 12:
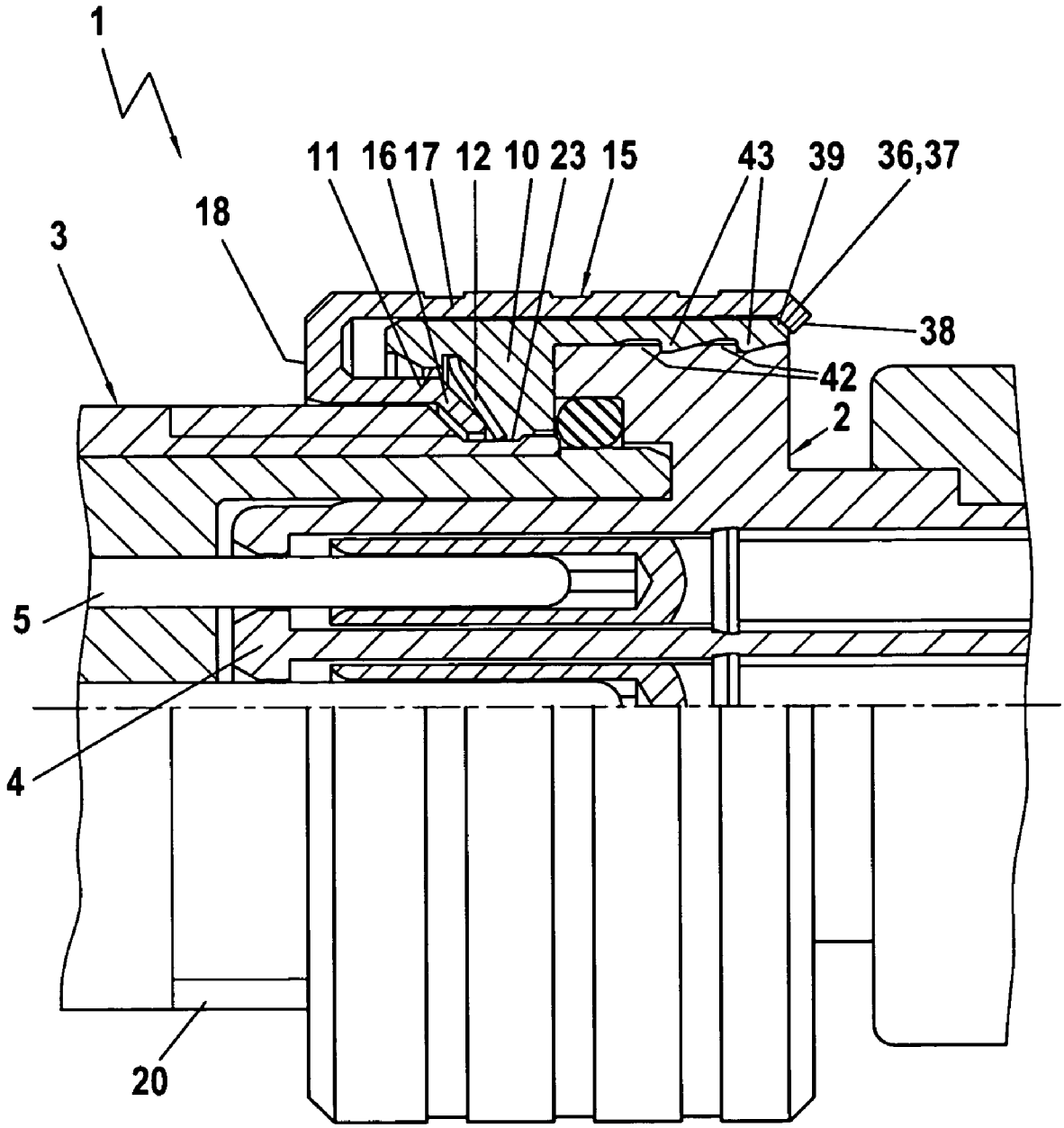
Figure 13:
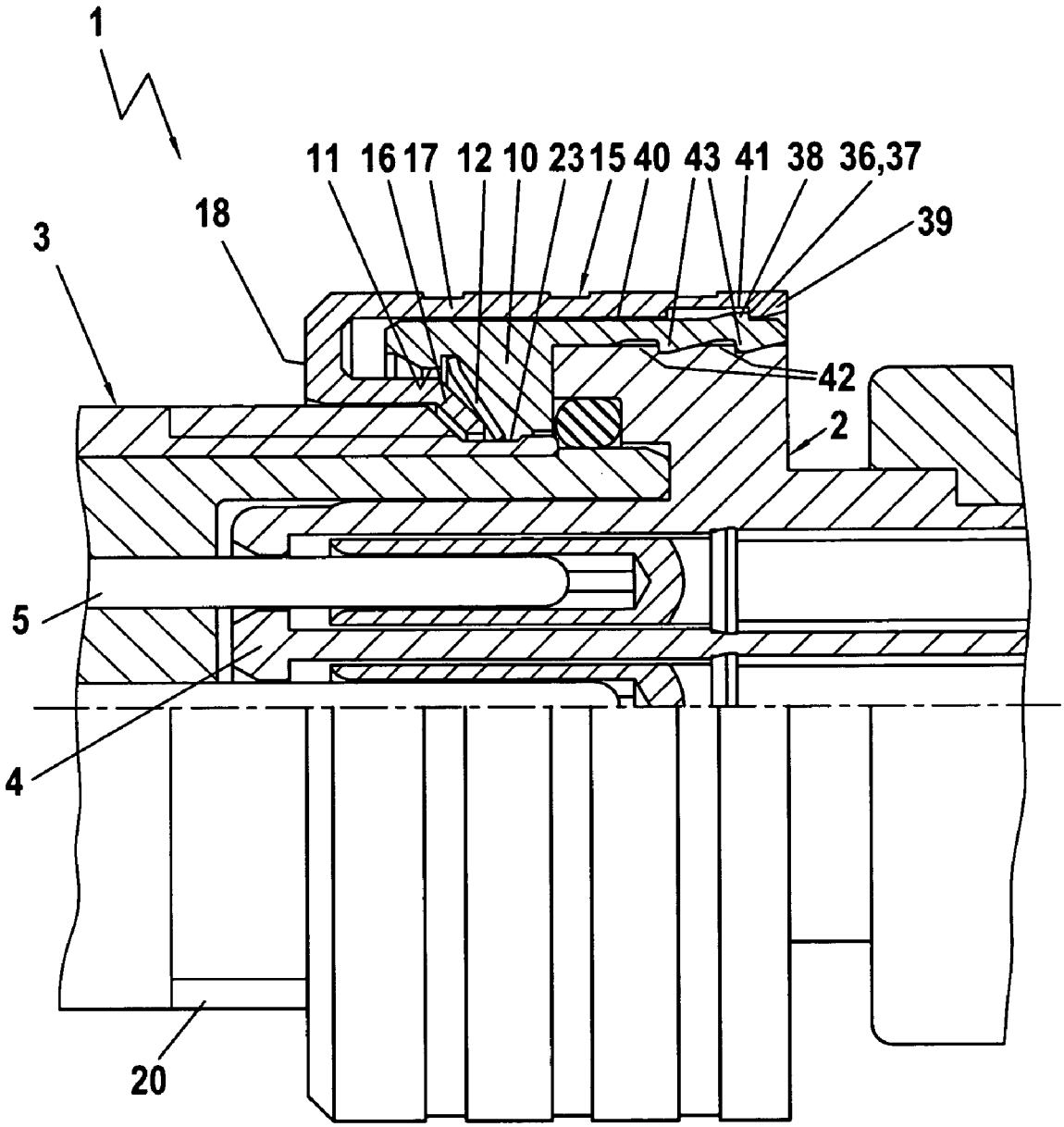
Figure 14:
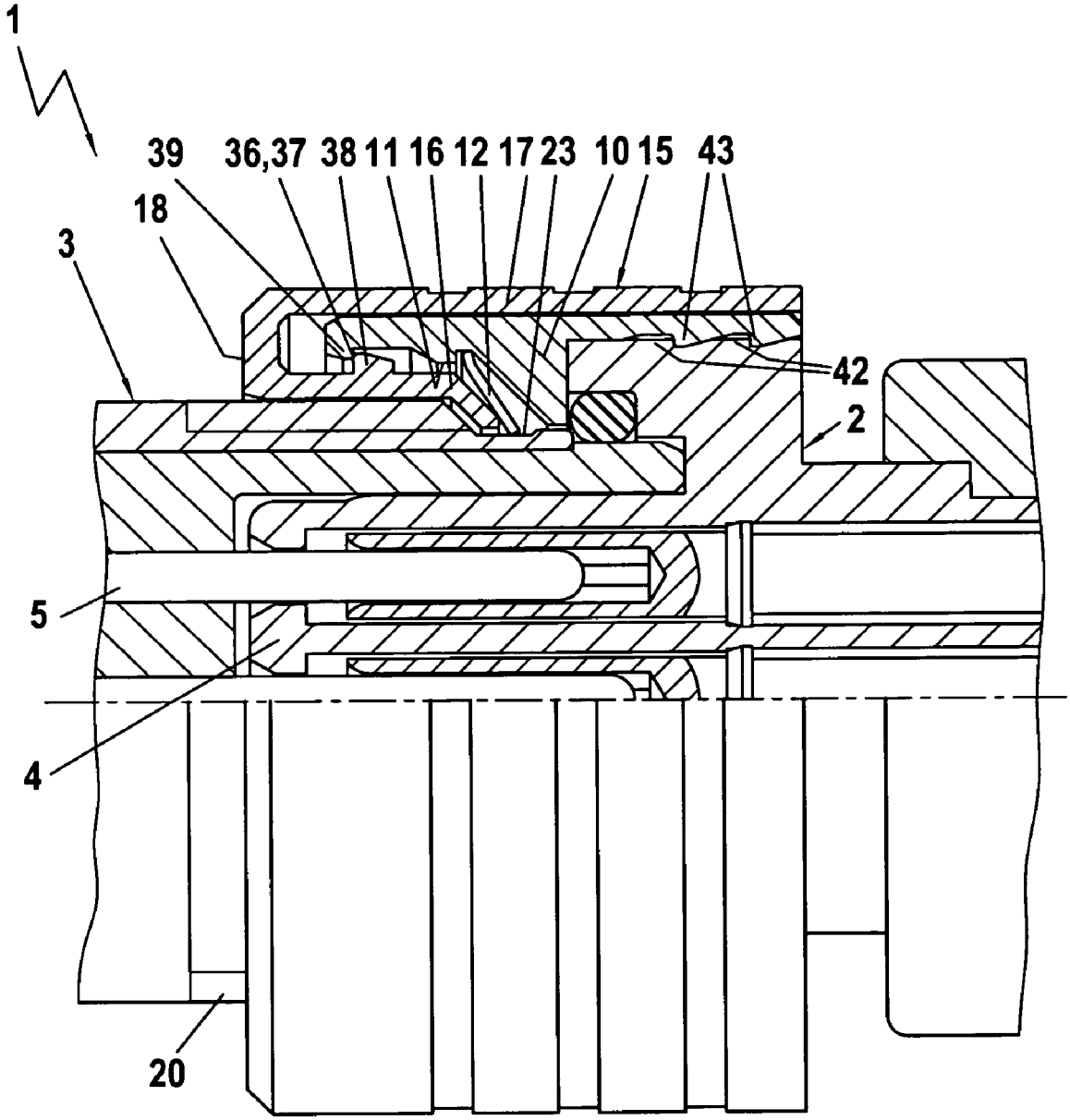

In the figures, respectively schematically,

FIGS. 1 to 6 show a longitudinal section through a plug connector according to the invention but in different states of connection, FIG. 7 shows a view as in FIG. 4 but in another embodiment, FIG. 8 shows a view as in FIG. 7, but in another application, FIGS. 9 and 10 respectively show a longitudinal section as in FIGS. 1 and 4 but in another embodiment, FIG. 11 shows a plan view of a particular embodiment of a spring ring or locking element, FIG. 12 shows an enlarged, partly cut-away longitudinal view of the plug connection according to the invention in the connected state, FIG. 13 shows a view as in FIG. 12 but in another embodiment, FIG. 14 shows a view as in FIG. 13 but in another embodiment.

DETAILED DESCRIPTION OF THE ILLUSTRATED EMBODIMENTS

In accordance with FIGS. 1 to 6, an electrical plug connector 1 according to the invention comprises a pair of mating electrical connectors including first plug section 2 and a second plug section 3. The plug connector 1 is used for the electrical connection of at least two electrical conductors or wires included in cords or cables such as shown at 35 in FIGS. 5 and 10. The first plug section 2 contains in its interior a first electrical coupling section 4. Similarly, the second plug section 3 contains a second electrical coupling section 5 in its interior. In the embodiment of FIGS. 1 to 6, the second coupling section 5 is constructed as a plug 6 (i.e., having male connecting elements in the form of pins 9, whilst the first coupling section 4 is formed by a socket 7 with female connecting elements such as sleeves. The two coupling sections 4, 5 are constructed complementary to one another so that plug 6 and socket 7 can be inserted one into the other in a plug or connect/disconnect direction 8 symbolized by a double arrow. By inserting the plug 6 into the socket 7 (the connect direction), an electrical connection is made between the coupling sections 4, 5 so that electrical leads connected to the coupling sections 4, 5 are in electrical continuity with one another in a fashion provided therefor. For this purpose, according to the embodiment shown the plug 6 can contain a pin 9 (or connecting element) for each lead to be contacted, which can be inserted in a matching pin receiver (sleeve) embedded in the female socket 7 and not shown here. These pin receivers are then respectively connected to the appropriate lead in a suitable and known fashion.

The first plug section 2 has a receiving sleeve 10 which is generally cup-shaped, having an outer generally cylindrical wall arranged coaxially to the first coupling section 4 with respect to the plug direction and which encircles the coupling section 4 in a ring shape to define an axis along the connect/disconnect direction 8. This receiving sleeve 10 holds a locking element 12 on an inner side 11 of the outer wall, facing the first coupling section 4.

In a preferred embodiment the locking element 12 comprises a spring ring (FIG. 11) which has a plurality of locking lugs or tabs 13 spaced apart in the circumferential direction and which project inwardly from an outer ring 34 of the spring ring 12.

The tabs or lugs of locking element or spring ring 12 are flexible so they may be displaced by a sliding, release sleeve 15 between a locking position shown in FIGS. 1, 2 and 4 and an unlocking position shown in FIGS. 5 and 6. The locking lugs 13 are flexible with respect to the ring 34, so they may resiliently flex in the plug direction 8 in a spring elastic fashion. During this movement of the tabs, (which, as will be explained, is actuated by manual manipulation of an axially slidable release sleeve 15), an inner cross-section 14 of the innermost engagement edges of the tabs 13 of the spring ring 12 changes. In the locking position (FIG. 2) this inner cross-section 14 is smaller than in the unlocking or release position (FIG. 5).

The locking lugs or tabs 13 are preferably already inclined in the connect direction in the locking position as in this case and specifically at an angle of inclination smaller than 90° relative to a line parallel to the axis and passing through the ring 34. The inclination of the locking lugs 13 is selected so that the angle of inclination is additionally reduced (i.e., the central opening 14 defined by the innermost engagement edges of the resilient tabs 13 is enlarged when the locking lugs 13 are transferred by release sleeve 15 to the unlocking position, as seen in FIG. 5. As a result of this orientation of the locking lugs 13, the forces required to move the locking lugs 13 into their unlocking position are reduced.

The method of construction of the spring ring 12 is such that its locking lugs or tabs 13 are angularly disposed as noted above and pre-stressed in the locking position. The movement of the individual locking lugs 13 into the unlocking position thus takes place against a restoring spring force of the spring ring 12, which, as will be understood, will exert a biasing force on the sliding sleeve 15 to return it to a fixed rest position.

The first plug section 2 is additionally equipped with a sliding sleeve 15 (or release sleeve) which is also arranged coaxially to the first coupling section 4 wherein the sliding sleeve 15 also encircles the first coupling section 4 in a ring shape. In the preferred embodiment shown here the sliding sleeve 15 has a substantially U-shaped profile with two U-legs or walls of different axial length. The shorter radially inner U-leg forms a shorter inner wall, referred to as an actuating section 16 of the sliding sleeve 15 whilst the longer radially outer U-leg or wall forms a grip section 17 of the sliding sleeve 15. Grip section 17 (manually engaged by a user) and actuating section 16 are interconnected by a collar 18 which extends transverse to the plug direction 8, which forms the U-base in the U-profile (as viewed in cross section) and is arranged adjacent with respect to a front or connecting end 19 of the receiving sleeve 10.

The sliding sleeve 15 is displaceably mounted on the receiving sleeve 10 for reciprocal sliding movement in the plug direction 8. In this case, FIGS. 1 to 4 respectively show a rest position of the sliding sleeve 15 whilst FIGS. 5 and 6 show a release position of the sliding sleeve 15. The actuating section 16 has a free inner edge which engages and interacts with the locking element 12 or with its locking lugs 13. The coupling between the sliding sleeve 15 and the locking element 12 is made such that any shift of the sliding sleeve 15 into its release position according to FIGS. 5 and 6 forces the locking element 12 or its locking lugs 13 to expand into the release position and permit the two connector plugs to be disconnected. For the case where the sliding sleeve 15 takes up its rest position, the spring force active on the locking element 12 ensures that this or its locking lugs 13 automatically strive to engage the outer surface of plug tab 20 and take up its locking position. The spring force of the locking element 12 or the locking lugs 13 also causes the sliding sleeve 15 to be driven into the rest position by the restoring force of the spring ring 12. Accordingly, the sliding sleeve 15 is automatically shifted into its rest position as soon as the locking element 12 takes up its locking position. The locking element 12 can then preferably take up its locking position when the two plug sections 2, 3 are completely inserted one in the other (i.e., connected). In any case, the locking element 12 takes up its locking position as soon as the two plug sections 2, 3 are separated from one another (i.e., disconnected or moved away from one another).

In accordance with FIGS. 1 to 6, the second plug section 3 has a plug tube 20 which is arranged coaxially to the second coupling section 5 with respect to the plug direction 8 and encircles this coupling section 5 in a ring shape. A ring-shaped peripheral locking step or recess 21 is constructed on the plug tube 20 on an outside 22 facing away from the second coupling section 5. In the preferred embodiment shown here this locking step 21 is produced by constructing a completely encircling annular groove 23 on the outside 22 of the plug tube 20, wherein the locking step 21 forms one of the axial boundary walls of the annular groove 23.

In another embodiment in which the plug tube 20 consists of plastic, such a locking step 21 or such an annular groove 23 can be omitted.

A plugged connection state between the two plug sections 2, 3 is made as follows with the plug connection 1 according to the invention:

In an initial (disconnect) state as shown in FIG. 1, the two plug sections 2, 3 are at a distance from one another. Directly before inserting the two plug sections 2, 3 into one another (i.e., connecting them), these are aligned flush to one another with respect to the plug direction 8.

In the state as shown in FIG. 2, the second plug section 3 is inserted so far into the first plug section 2 that a leading front end 24 of the second plug section 3 comes to rest against the axially inclined locking lugs 13 in their smaller opening. The locking lugs 13 are still located in their locking state and arranged to be engaged by the second plug section 3, and axially moved in the connect direction to form a longer inner diameter and receive the second plug section 3.

When the second plug section 3 is inserted more deeply into the first plug section 2, the locking lugs 13 are bent and flex in the plug-in or connect direction, that is towards the unlocking position. In the state as shown in FIG. 3, the leading axial end 24 of the second plug section 23 is inserted into the first plug section 2 until it makes contact with a seal 25 located in a circumferential recess formed on the inner surface of the side wall of the first plug section 2. This seal 25 is constructed as an O-ring here.

In the state as shown in FIG. 4, the second plug section 3 has reached its maximum depth of penetration into the first plug section 2. This maximum depth of penetration is defined here by a stop 26 which is formed by an annular step or wall in the first plug section, on which the leading axial end 24 of the second plug section 3 axially comes to rest. At this pre-determined insertion depth the spring-loaded locking element 12 can now automatically go over into its locking position in the area of the annular groove 23 whereby the locking lugs 13 grip behind (i.e., facing in the disconnect direction) the locking step 21 in the annular groove 23. As a result, the second plug section 3 is secured by the releasable locking element 12 against retraction in the first plug section 2 in a form-locked fashion.

If the plug tube 20 consists of plastic and no locking step 21 is constructed thereon, the locking element 21 which suitably consists of metal, can be supported with its locking lugs 13 directly on the outside 22 of the plug tube 20. As a result of the combination of materials (relatively soft plastic of the plug tube 20 and relatively hard metal of the locking element 12), sufficient locking force is achieved between the plug sections 2, 3, especially with relatively sharp-edged locking lugs 13.

At the same time the inclination (or off-center portion) of the tabs 13 towards the plug connect direction 8 provided for the locking position of the locking lugs 13 in this case brings about a type of wedging or self-inhibition which can be overcome only with extremely large forces whereby the securing between the plug sections 2, 3 is extremely effective. In the connection state between the plug sections 2, 3 achieved in FIG. 4, the seal 25 is located radially between the plug sections 2, 3, thereby sealing these mating plug sections effectively with respect to one another.

The pre-determined insertion depth between the plug sections 2, 3 is selected among other things so that in every case correct electrical continuity is ensured between the connecting elements of the coupling elements 4, 5. In other words, the pins 9 penetrate sufficiently deeply into the associated pin receivers.

Releasing the plug connection 1, that is retracting the second plug section 3 from the first plug section 1, can be achieved in accordance with FIGS. 5 and 6 by transferring the sliding sleeve 15 from its rest position (FIG. 4) into its release position. In the release position the sliding sleeve 15 (FIG. 5) with its actuating section 16 forcing the individual locking lugs 13 into their expanded, unlocking position. In this unlocking position the locking lugs 13 release the annular step 21 again as a result of the enlarged inner cross-section 14 (see FIG. 5). Whilst the sliding sleeve 15 is held tightly in its release position, the second plug section 3 can be retracted from the first plug section 2 in accordance with FIG. 6. At the latest when the second plug section 3 has been completely retracted from the first plug section 2 in accordance with FIG. 1, the sliding sleeve 15 can be released again whereby the restoring force of the locking lugs 13 then automatically drives the sliding sleeve 15 into its rest position.

For an optimum mode of action of the actuating section 16 for unlocking the plug sections 2, 3, said actuating section 16 of the sliding release sleeve 15 interacts with the locking lugs 13 at its end facing the locking element 12. Furthermore, at this end the actuating section 16 can be bevelled at the same inclination as that exhibited by the locking lugs 13 in their unlocking position. The inner wall 11 of the receiving sleeve 10 is also bevelled in accordance with this inclination adjacent to the locking element 12.

The inner cross-section 27 of the inner wall of the activating section 16 of the sliding sleeve 15 and outer cross-section 28 of plug tube 20 form an axial guide between the plug tube 20 and receiving sleeve 10. This facilitates location of the connection state when inserting the plug sections 2, 3. This axial guide is achieved here by an inner cross-section 27 of the sliding sleeve 15 in the area of its actuating section 16 being selected as approximately the same size or slightly larger than an outer cross-section 28 of the plug tube 20.

According to a preferred variant, the plug tube 20, the receiving sleeve 10 and the locking element 12 are made of metal. In addition, the locking element 12 is connected to the outer sleeve 10 in a radially external electrically conducting fashion and is constructed so that in the inserted connection state it also makes electrical contact with the plug tube 20. In this case, contact with the plug tube 20 is made via a plurality of points distributed circumferentially so that quasi-annular contact between locking element 12 and plug tube 20 is formed. The contact between locking element 12 and receiving sleeve 10 is also constructed as closed ring-shaped since the locking element 12 is inserted in an annular recess 29 constructed on the inside 11 of the receiving sleeve 10. As a result of this method of construction, in the contact state there is an electrically conducting connection between plug tube 20 and receiving sleeve 10 which completely surrounds the electrical contact of the coupling sections 4, 5. Accordingly, the plug connection 1 according to this embodiment of the invention is EMC-compatible and makes it possible to screen electromagnetic impulses or interference which can be diverted from the plug connection 1 via the plug tube 20 or via the receiving sleeve 10.

Accordingly, in an advantageous embodiment the plug sections 2, 3 are constructed such that in the connection state they protect the electrical connection of the relevant electrical coupling sections 4, 5 from electromagnetic interactions with the environment of the plug sections 2, 3. In this way, the plug connection 1 is constructed as electromagnetically compatible so that it can be used in EMC-sensitive installation situations. EMC stands for Electro Magnetic Compatibility.

In the same way, it can be expedient to construct the plug sections 2, 3 such that in the connection state they screen the electrical connections of the coupling sections 4, 5 from electromagnetic interference and divert electromagnetic interference away from the electrical connection of the coupling sections 4, 5. The screening and diversion of the electromagnetic interference also improves the electromagnetic compatibility of the plug connection 1. Electromagnetic interference formed in the vicinity of the plug connection 1 cannot act on the electrical connection of the coupling sections 4, 5 and equally, electromagnetic interference propagating inside the leads which are interconnected by means of the plug connection 1 cannot enter into its vicinity. The diversion of the electromagnetic interference ensures that the interference cannot add up to impermissibly high values.

The EMC compatibility of the plug connection 1 or close screening of the plug connection combined with the immediate diversion of interference can be achieved in the plug connection 1 as shown for example by constructing the receiving sleeve 10, the plug tube 20 and the locking element 12 of metal, wherein the locking element 12 is electrically connected to the receiving sleeve 10 and in the connection state of the plug sleeve 20 is in electrical contact at a plurality of spaced contact points distributed around the circumference. With this method of construction, the desired EMC compatibility or the desired screening and diversion can be achieved almost without additional expenditure since the electrically conducting locking element 12 makes it possible to achieve most effective circumferential contact between the plug sections 2, 3 in the connection state.

Since the sliding sleeve 15 need not be involved in the electrical contact between plug tube 20 and receiving sleeve 10, the sliding sleeve 15 can suitably be made of a plastic.

FIG. 7 shows a variant of the plug connection 1 according to the invention in which the sliding sleeve 15 is held in a loss-proof (i.e., it may not be easily removed) fashion on the first plug section 2 in a different way compared with the embodiment in FIGS. 1 to 6. Furthermore, in this embodiment the plug tube 20 is provided with an outer thread 30 on its outside 22. The positioning of the outer thread 30 is selected such that in the connection state shown in FIG. 7, it has no interaction with the receiving sleeve 10 or with the sliding sleeve 15.

With the aid of the outer thread 30 the plug connection 1 according to the invention is backwards compatible with respect to the second plug section 3, that is the second plug section 3 of the plug connection 1 according to the invention can be used, as shown in FIG. 8, in connection with a conventional first plug section 2' which is fitted with a screw cap 31 which interacts with the outer thread 30 after insertion of the coupling sections 4, 5 in order to secure the two plug sections 2' and 3 one to the other.

FIGS. 9 and 10 show another embodiment in which, in contrast to the previous embodiments, the first coupling section 4 located in the first plug section 2 is now constructed as a plug 6 whilst the second coupling section 5 of the second plug section 3 is constructed as a socket 7. Another particular feature will be seen in the embodiment in FIGS. 9 and 10 in that the plug tube 20 in this embodiment is fitted with an inner thread 32 so that the second plug section 3 can be used with a conventional first plug section (standard plug) not shown here, which is provided with a corresponding outer thread. In addition, the second plug section 3 also contains a seal 33 which interacts with a standard plug in the connection state. In connection with the first plug section 2 this seal 33 according to FIG. 10 is inherently functionless.

As an example, FIG. 11 shows a variant for constructing the locking element 12 in the form of a spring ring. In this case, the locking element or the spring ring 12 has a closed outer or peripheral ring 34 from which the individual locking lugs or tabs 13 project radially inwards. The locking element 12 can be manufactured particularly simply, e.g. as a stamped element. Other methods of construction are fundamentally also feasible for the locking element 12. In addition, the locking lugs 13 can also be provided with recesses so that the spring stiffness of the spring ring 12 or the locking lugs 13 can thus be varied.

Both the first plug section 2 and also the second plug section 3 can be manufactured such that after their manufacture their coupling sections 4, 5 are already fixedly connected to their respective leads. Alternatively, a self-assembly embodiment is also possible in which the plug sections 2, 3 are not yet connected to the leads so that the respective leads can be connected at the particular usage location.

Basically, both plug sections 2, 3 can each be attached to one end of a cable 35 (see FIGS. 9 and 10) in which the electrical leads leading to the individual contacts of the respective coupling section 4, 5 are combined. It is also possible to have an embodiment in which at least one of the plug sections 2, 3 forms a socket which is installed fixedly in a casing of an electrical device.

Further particular features of the present plug connection 1 are shown in FIGS. 12 to 14, some features of which are also present in the preceding embodiments and are explained in detail subsequently. In FIGS. 12 to 14 the plug connection 1 is made, that is the two mating electrical plug sections 2, 3 are inserted completely into one another to form a connection. Accordingly, the locking element 12 (with its locking lugs 13) engages in the annular groove 23. The two mating electrical plug sections 2, 3, as well as the annular groove 23 and locking element 12 are matched to one another such that in this securing state the locking element 12 can take up its locking position. In the preferred embodiments shown here, especially in the embodiments in FIGS. 1 to 7 and 9 and 10, the axial displaceability of the sliding sleeve 15 is matched to the spring-elastic movability of the tabs 13 of the locking element 12 such that the sliding sleeve 15 driven by the locking element 12 takes up its rest position when the locking element 12 is located in its locking position. This is achieved with the aid of an axial stop 36 which defines the rest limit position of the sliding sleeve 15. The locking element 12 presses the sliding sleeve 15 against this axial stop 36 (typically in the form of a circumferential surface) so that it abuts thereon.

In the embodiments shown in FIGS. 1 to 6 and 14 the sliding sleeve 15 is held on the inside 11 of the outer wall of the receiving sleeve 10. A position for the support especially protected from contamination is hereby obtained which ensures that the sliding sleeve 15 and thus the plug connector 1 can operate without fault for a long time.

In the embodiments in FIGS. 1 to 7, 9 and 10 as well as 12 to 14, the sliding sleeve 15 is held by means of at least one locating device 37 on the receiving sleeve 10. In the preferred exemplary embodiments shown here the locating device 37 at the same time forms the aforementioned axial stop 36 which defines the rest position of the sliding sleeve 15.

Each of said locating devices 37 comprises at least one locating edge which for clarity is merely designated as 38 in FIGS. 12 to 14 and is located on the release sleeve 15. Moreover, each locating device 37 comprises a locating contour (typically in the form of an annular circumferential radial wall) which for clarity is merely designated as 38 in FIGS. 12 to 14. In the rest position of the sliding sleeve 15 the respective locating edge 38 abuts axially against the respective locating contour 39 on the receiving sleeve 10, forming the axial stop 36. A particular feature of this locating device 37 is seen in that each locating edge 38 is axially removable from the respective locating contour 39 so that the sliding sleeve 15 can be transferred into its unlocking or release position.

The respective locating edge 38 of the release sleeve 15 can either be formed by a single locating edge 38 which encircles in a circumferential shape or by a plurality of locating edges 38 arranged and spaced circumferentially. The same also applies to the locating or limiting contour 39 of the receiving sleeve 10.

In the embodiments in FIGS. 7, 9, 10 and 12 the locating device 37 is constructed at an end of the outer wall of the sliding sleeve 15 distant from the actuating section 16 and the mating connector. For this purpose the outer cylindrical wall of the sliding sleeve 15 has an inwardly projecting end section, distal from the mating connector which forms the locating edge 38. The relevant locating contour 39 is in this case constructed on the receiving sleeve 10 but in another embodiment can also be constructed on the first plug section 2.

In the embodiment of FIG. 13 the locating device 37 is constructed on an outer peripheral surface 40 of the receiving sleeve 10 which faces away from the first coupling section 4. In this case, the locating device 37 is constructed radially between the sliding sleeve 15 and the receiving sleeve 10. In this way, an inner locating device 37 or an inner support of the sliding sleeve 15 on the receiving sleeve 10 is also achieved in this embodiment which is advantageously protected from contamination. In this locating device 37 the locating edge 38 engages in a circumferential groove 41 which is delimited axially by the locating contour 39 at the distal end. In the variant according to FIG. 13 the groove 41 is formed on an inside surface of the sliding sleeve 15 whilst the at least one locating edge 38 projects outwards from the opposing outside surface 40 of the receiving sleeve 10. Alternatively, the groove can also be formed on the outside 40 of the receiving sleeve 10 whilst the at least one relevant locating edge then projects inwards on the inside of the sliding sleeve 15.

In the embodiments in FIGS. 1 to 6 and 14 the locating device 37 is formed on the inside 11 of the receiving sleeve 10 proximal to the mating connector and specifically radially between the actuating section 16 and the receiving sleeve 10. For this purpose the sliding sleeve 15 has on an outer surface of actuating section 16 at least one outwardly projecting locating edge 38 which grips behind the locating contour 39 formed on the inside 11 of the proximal or forward end of receiving sleeve 10. The at least one locating edge 38 can also be formed on the receiving sleeve 10 whilst the relevant locating contour 39 would be provided on the actuating section 16. In this embodiment the locating device 37 lies completely inside the sliding sleeve 15 and inside the receiving sleeve 10 whereby the locating device 37 is especially well protected from contamination.

The embodiments in FIGS. 12 to 14 are additionally characterized by another particular feature. In these embodiments the receiving sleeve 10 is respectively configured as a separate component with respect to the first plug section 2. The separate receiving sleeve 10 is in this case attached coaxially externally to the first plug section 2. Basically the receiving sleeve 10 could be screwed onto the first plug section 2 for which the receiving sleeve 10 and the first plug section 2 must then be provided with mutually complementary threads.

Preferred however is the embodiment shown here in which the first plug section 2 has an outer toothed or barbed structure 42 with sawtooth shaped rings extending circumferentially about an outer side facing the receiving sleeve 10. Complementary thereto the receiving sleeve 10 has a corresponding inner toothed (or barbed) structure 43 on its inner side facing the first plug section 2. The receiving sleeve 10 is arranged such that it can be placed axially onto the first plug section 2. In the inserted state shown the complementary toothed structures 42, 43 intermesh in a form-locking fashion and prevent or impede the receiving sleeve 10 from being removed from the first plug section 2.

The arrangement of the receiving sleeve as a separate component results in easier assembly. The receiving sleeve preferably consists of a plastic in this embodiment.

Having thus disclosed in detail a number of embodiments of the invention, persons skilled in the art will be able to modify certain of the structure disclosed and to substitute equivalent elements for those illustrated while practicing the principle of the invention. That is, the limit position for the release sleeve could be to the left of the locking positions shown in FIGS. 4 and 12 (i.e., in the disconnect direction). It is thus intended that all such modifications and substitutions be covered as they are embraced within the spirit and scope of the claims.

The invention claimed is:

1. An electrical connector comprising:

a first plug section including a first electrical coupling section having a first connecting element, and a receiving sleeve secured to an exterior of said first coupling section;

a second plug section including a second electrical coupling section having a second connecting element adapted to couple electrically and mate with said first connecting element when said first and second plug sections are connected in electrical coupling relation;

a locking element mounted to said receiving sleeve of said first plug section and in opposing relation with said second coupling section, and including at least one resilient, flexible tab; and a release sleeve received on said receiving sleeve and slidable therealong between a locking position and a release position, said release sleeve including an outer, generally ring-shaped section and an inner actuating section adapted to engage said flexible tab of said locking element when said release sleeve is moved to said release position thereby to release said locking element from said second coupling section, wherein when said first and second plug sections are connected together and said release sleeve is in said locking position, said tab of said locking element engages said second coupling section to releasably secure said first and second plug sections together, and said tab engages said actuating section of said release sleeve to bias said second plug section into engagement with a stop member of said first plug section.

2. The connector of claim 1 wherein said stop member further defines a limit for axial movement of said release sleeve when said first and second plug sections are disconnected.

3. The connector of claim 1 wherein said outer section of said release sleeve comprises an outer peripheral wall forming a gripping section, and said actuating section thereof is generally ring-shaped and extends axially of said first plug section and within said outer wall of said receiving sleeve of said first plug section, said actuating section having a free circumferential edge engaging said tab of said locking element in both of said locking position and said release position.

4. The connector of claim 3 wherein said outer section of said release sleeve is a generally ring-shaped peripheral wall;

wherein said actuating section comprises a generally ring-shaped inner wall of axial length less than the axial length of said peripheral wall, and spaced radially inward of and coaxial with said peripheral wall;

said release sleeve further including a collar interconnecting said peripheral wall and said inner wall at a circumferential location facing said second plug section.

5. The connector of claim 4 wherein said stop member of said first plug section includes a circumferential stop surface on said receiving sleeve constructed to engage said second plug section and limit the axial motion of said second plug section in the disconnect direction, whereby said release sleeve is free to be moved by manual manipulation of said gripping section of said release sleeve to said release position, and a pre-stressed force of said tab of said locking element returns said release sleeve to said locking position when said release sleeve is released;

wherein said locking element biases said release sleeve against said circumferential stop surface of said receiving sleeve in said locking position;

whereby said release sleeve may not be readily manually removed from said receiving sleeve.

6. The connector of claim 5 wherein said locking element comprises a rigid peripheral ring and a plurality of inwardly extending flexible tabs circumferentially spaced about said peripheral ring, said tabs each defining an inner edge, said inner edges defining an aperture, said aperture enlarging when said first plug section receives said second plug section, said tabs retaining said first and second plug sections in releasable locking engagement.

7. The connector of claim 5 wherein said stop surface of said receiving sleeve comprises a circumferential surface extending generally radially of said receiving sleeve, and said actuating section of said release sleeve includes a circumferentially extending locating surface located to engage via said locking element said second plug section and urge said second plug section into engagement with said circumferential stop surface of said receiving sleeve and thereby to limit axial motion of said release sleeve in said disconnect direction.

8. The connector of claim 6 wherein said peripheral wall of said release sleeve includes a circumferential edge remote from said collar, said edge turned in toward said axis and adapted to engage said receiving sleeve in said locking position thereby to limit the axial motion of said release sleeve in the direction of disconnect and resist manual removal of said release sleeve from said first plug section.

9. The connector of claim 6 wherein said peripheral wall of said release sleeve includes an axially-facing generally cylindrical inner surface defining a circumferential groove extending an axial distance defining both said release position and said locking position of said release sleeve.

10. The connector of claim 9 wherein said sleeve receiving includes a locating member extending into said circumferential groove of said release sleeve for limiting the axial movement of said release sleeve and retaining said release sleeve in assembled relation with said receiving sleeve.

11. The connector of claim 1 wherein said receiving sleeve includes a generally cylindrical peripheral wall having a radially extending circumferential stop surface for engaging said release sleeve to define an axial position for limiting the axial motion of said release sleeve in a disconnect direction.

12. The connector of claim 8 wherein said first plug section and said receiving sleeve are coupled together by at least one circumferentially extending, mating toothed structure.

13. The connector of claim 4 wherein said locking element is made of metal and includes a continuous peripheral ring and a plurality of circumferentially spaced inwardly-extending tabs, each tab having an inner edge for engaging a circumferential surface of a coupling section of a mating connector;

wherein said inner wall of said release sleeve includes a free end spaced from said collar for engaging said locking element, and further includes a circumferential contact portion for engaging said tabs of said locking element; and wherein said tabs engage and grip an outwardly facing cylindrical surface of said second coupling section in locking engagement when said second plug section is connected to said first plug, said tabs biasing said release sleeve toward said rest position when said tabs are in locking engagement with said second plug section.

14. The connector of claim 13 wherein when said first and second mating plug sections are connected, the plurality of circumferentially spaced tabs of said locking element grip said first coupling section in locking engagement and extend radially inwardly and in a direction of connection; said tabs being stressed and engaging said actuating section of said release sleeve to bias said release sleeve in the disconnect direction.

15. The connector of claim 14 wherein said tabs of said locking element are solid, flat, thin flexible metal tabs extending generally inward, and are inclined toward the direction of connection.

16. The connector of claim 15 wherein said outer peripheral wall of said release sleeve includes a distal free end opposite said collar, said free end extending inwardly to engage a radial portion of said first plug section and thereby limit the axial motion of said release sleeve in the disconnect direction.

17. The connector of claim 16 wherein said first plug section includes an annular radial wall positioned to engage and limit axial motion of said first plug section in a connect direction; and a circumferential recess facing radially inwardly; and wherein said connector further includes a sealing ring in said circumferential recess constructed and arranged to engage and seal against an outer circumferential wall of said second plug section when said first and second plug sections are connected.

18. The connector of claim 16 wherein said second plug section includes a cylindrical, outer, metal plug tube; and wherein said locking element and said receiving sleeve of said first plug section are metal, whereby said connector is shielded against electromagnetic interference when said first and second plug sections are connected.

19. The connector of claim 1 wherein said second plug section includes an outer cylindrical surface defining an annular lock surface for engagement with said locking element when said plug sections are connected together.

20. The connector of claim 19 wherein said first connecting element of said second plug section are male connecting elements.

21. An electrical connector comprising:

a connector body carrying electrical connecting elements, and having a peripheral wall extending along a direction of connect/disconnect defining an axis and having a circular front edge defining an opening for receiving a mating connector, said body including a locator surface extending in a generally radial direction;

a locking element carried by an inner surface of said peripheral wall of said connector body, said locking element including a peripheral ring and a plurality of circumferentially spaced, flexible, resilient tabs extending from said ring inwardly toward said axis and inclined in the direction of insertion of a mating connector; and a release sleeve slidably mounted on said connector body for reciprocal motion in said direction of connect/disconnect between a first position and a release position, said release sleeve including generally concentric inner and outer walls spaced to be received on said peripheral wall of said body cupping over said front edge thereof;

said inner wall of said release sleeve including a limit surface adapted to engage said locator surface of said body when said release sleeve is moved to said first position; and wherein said tabs of said locking element bias said release sleeve in said disconnect direction when said release sleeve is in said rest position, thereby providing a preload force releasably forcing said release sleeve to said connector body whether or not said connector is coupled to a mating connector, thereby reducing noise by vibration during use.

* * * * *

UNITED STATES PATENT AND TRADEMARK OFFICE

CERTIFICATE OF CORRECTION

PATENT NO. : 7,695,302 B2
APPLICATION NO. : 10/557057
DATED : April 13, 2010
INVENTOR(S) : Roland Eissner It is certified that error appears in the above-identified patent and that said Letters Patent is hereby corrected as shown below:

In the Specification:

Column 5, Line 26, After "plug" please delete "tab" and replace with --tube--.

Signed and Sealed this

Twenty-first Day of September, 2010

David J. Kappos

David J. Kappos
*Director of the United States Patent and Trademark Office*